US009448537B2

(12) United States Patent
Lindsay et al.

(10) Patent No.: US 9,448,537 B2
(45) Date of Patent: Sep. 20, 2016

(54) REVERSIBLE COIN HOLDER

(71) Applicants: Steven J Lindsay, Kearney, NE (US); Bryce S Lindsay, Kearney, NE (US)

(72) Inventors: Steven J Lindsay, Kearney, NE (US); Bryce S Lindsay, Kearney, NE (US)

( * ) Notice: Subject to any disclaimer, the term of this patent is extended or adjusted under 35 U.S.C. 154(b) by 0 days.

(21) Appl. No.: 14/120,028

(22) Filed: Apr. 16, 2014

(65) Prior Publication Data

US 2016/0096283 A1 Apr. 7, 2016

(51) Int. Cl.
*G04D 1/02* (2006.01)

(52) U.S. Cl.
CPC ..... *G04D 1/025* (2013.01)

(58) Field of Classification Search
CPC ..... B25B 1/2436; B25B 1/2442; B25B 5/06; B25B 5/16; B25B 5/163
See application file for complete search history.

(56) References Cited

U.S. PATENT DOCUMENTS 2,261,055 A 9/1941 Dulaney
2,460,679 A 2/1949 Clay
4,767,110 A * 8/1988 Yang ..... B25B 1/20 269/258
4,969,638 A * 11/1990 Yang ..... B25B 1/2426 269/258
5,799,933 A * 9/1998 Yang ..... B25B 1/2426 269/258
6,152,435 A * 11/2000 Snell ..... B25B 1/2452 269/268
7,226,047 B1 * 6/2007 Beauchamp ..... B23K 37/0533 269/43
7,699,299 B2 * 4/2010 Yoshioka ..... B28B 1/002 156/196
2007/0241490 A1 * 10/2007 Myers ..... B25B 1/103 269/43
2016/0096283 A1 * 4/2016 Lindsay ..... B26D 3/08 83/880

OTHER PUBLICATIONS

2 Vintage Antique Rotating Adjustable Jaws Watch Movement Holder Jewelers Tools, website: http://www.ebay.com/itm/360897134390, accessed Apr. 5, 2014, 3 pages.
Watch movement holder C&E Marshall Co. for watchmaker, website: http://www.ebay.co.uk/itm/400431246526, accessed Apr. 5, 2014, 3 pages.
Vintage Marshall USA Movement Holder 4 Sided in Box Watchmaker Tool VG Condition, website: http://www.ebay.com/itm/321313433062, accessed Apr. 5, 2014, 4 pages.
Vintage 4-Sided Movement Holder USA Watchmaker Tool Very Good Condition, website: http://www.ebay.com/itm/321365937042, accessed Apr. 5, 2014, 3 pages.
Pro Watch Case Bracelet Holder Watchmaker Repair Tools Gray my, website: http://www.ebay.com/itm/400686759051, accessed Apr. 5, 2014, 3 pages.
HR Style Pocket Watch & Bracelet Wristwatch Movement Holder Watchmaker Vise Tool, website: http://www.ebay.com/itm/331125545584, accessed Apr. 5, 2014, 3 pages.
Holder for Mechanical and Quartz Movements Swiss Type Tool, website: http://www.ebay.com/itm/301144622732, accessed Apr. 5, 2014, 3 pages.
Vintage Meyers No. 58 Movement Holder With All 8 Dies for Watch Repair, site: http://www.ebay.com/itm/251454356487, accessed Apr. 5, 2014, 3 pages.
Bergeon 4039 Reversible Watch Movement Holder, website: http://www.esslinger.com/bergeon-4039-reversible-watch-movement-holder.aspx, accessed Apr. 5, 2014, 2 pages.
Movement Holders, website: http://www.ofrei.com/page244.html, accessed Apr. 5, 2014, 11 pages.

* cited by examiner

*Primary Examiner* — Lee D Wilson

(57) ABSTRACT

A reversible object holder. More specifically, the invention relates to a reversible coin holder for securely clamping various sizes of coins.

5 Claims, 8 Drawing Sheets

FIG. 11
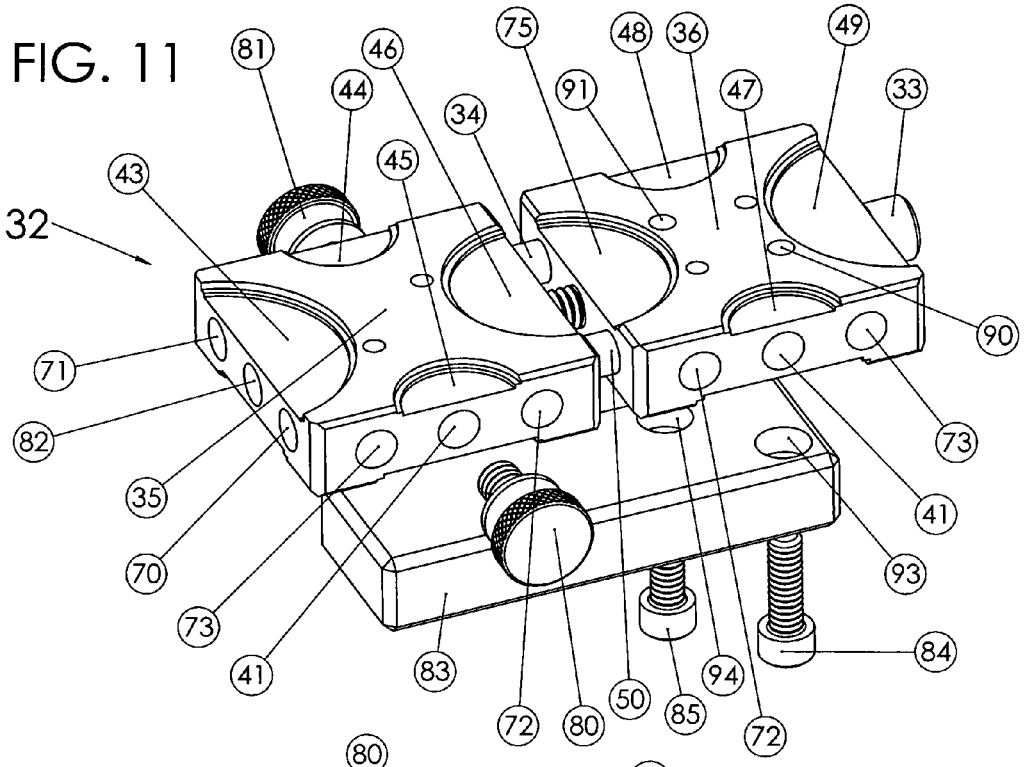
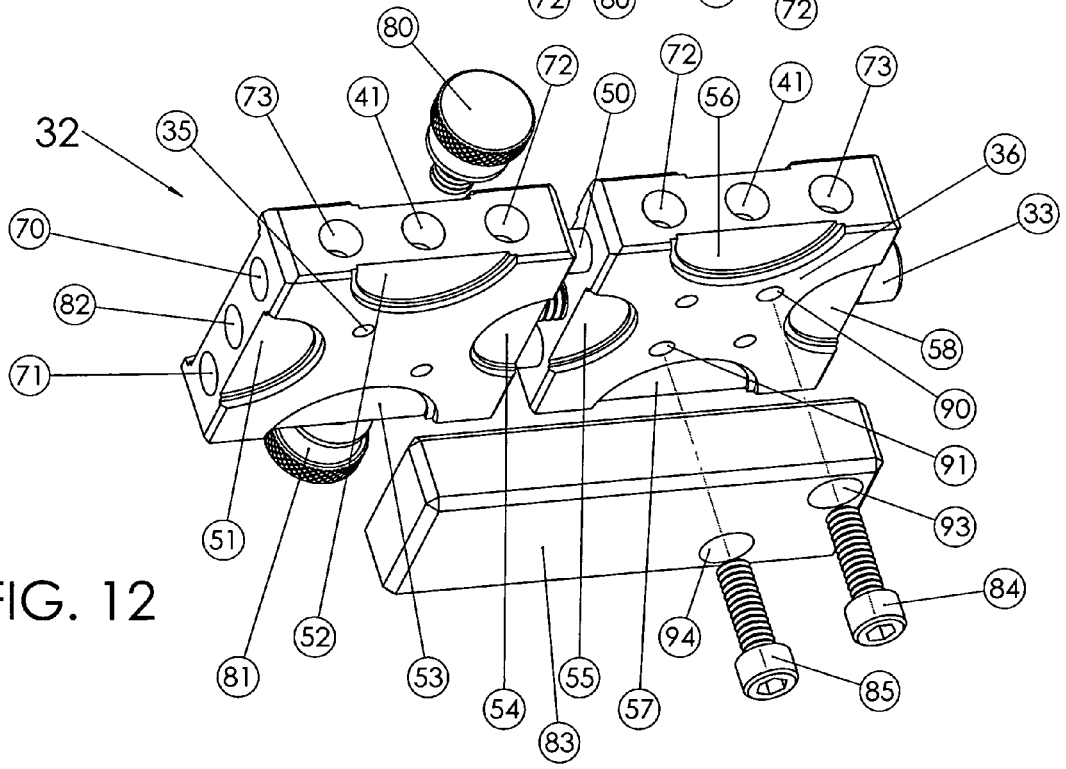
FIG. 12

REVERSIBLE COIN HOLDER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT

Not Applicable.

DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

1. Field of Invention

The present invention relates to a holder or vise for objects, more particularly, reversible and flippable jaws for securely clamping various sizes of coins.

2. Description of Related Art Including Information Disclosed Under 37 cfr 1.97 and 1.98

In recent times, engraving artists have adopted the use of coins as a canvas in which to carve beautiful designs and styles of art work. Collectors, seeing the appeal of these coins, will acquire them at the cost of many thousands of dollars.

Coin carving artists use hammers, chisels, and pneumatic impact devices to create their art. These tools require that the coin be held rigid during carving. The most secure way of holding a coin is for a large percentage of the circumference of the coin be held by jaws which fit that particular circumference precisely. In this way, there is less chance that the edges of the coin will be damaged by the jaws during some of the more severe operations carried out by the coin carving artist.

These artists are familiar with a number of methods of holding coins. For example, a set of pins protruding from the top of the jaws of an engravers ball vise (such as disclosed in U.S. Pat. No. 7,290,760 to Lindsay). Another method includes devices similar to a small three jaw chuck. Another is a tube, where the inside diameter of one end of the tube is machined to fit the diameter of a particular coin, and made into a collet. The collet can then be closed tight around the coin either with a vise or a screw that is inserted between the two halves and then tightened. Still another method is two half circles, machined as two flat templates or jaws, and whos inside diameter matches a particular coin. These half circles are then secured on the top of a vise.

This last method, consisting of two half circles, works well, but in order to cover all six of the current United States coin sizes, one would need six sets of jaws (a total of twelve individual jaws). This is an inelegant solution for craftsmen and artists.

U.S. Pat. No. 2,261,055 to Dulaney discloses a holder meant to secure watch movements while a horologist performed work on the watch. The Dulaney device is four sided, allowing various shapes to be held depending on the configuration of the device. The operations performed on watch movements are less severe than those on coins, and the design of the Delaney device does not allow for the rigidity required by coin carvers.

This inadequacy is due to a number of issues. One problem is that the jaws typically do not offer a very large percentage of contact between the device and the circumference of the held object, a necessity for coin carving. Another, more difficult problem, is that the clamping screw is quite far away from the object being clamped. This is not an issue for watch movements, as the horologist needs delicacy to avoid damaging his work. In fact, usually the clamping screw is a thumb screw; meaning it would be quite difficult to over tighten the device. If, however, this thumb screw is replaced with one that can be turned with a wrench, and the torque necessary to hold fast a coin is applied, the device will flex.

BRIEF SUMMARY OF THE INVENTION

It is the object of this invention to provide coin holder with jaws that are conveniently reversible for clamping multiple sizes of coins without the need for many separate jaws. It is also the object of this invention to provide a coin holder that can securely clamp coins without damaging the edges or the opposite side of the coin that the artist or craftsman is working on.

BRIEF DESCRIPTION OF THE SEVERAL VIEWS OF THE DRAWING(S)

An Embodiment of the present invention is described below with reference to attached drawing figures, wherein:

Reversible Coin Holder

FIG. 11 is a perspective view of a fourth embodiment of reversible coin holder jaws that have been integrated with prior art clamping mechanism;

FIG. 12 is a perspective bottom view of FIG. 11;

DETAILED DESCRIPTION OF THE INVENTION

Figure 1:
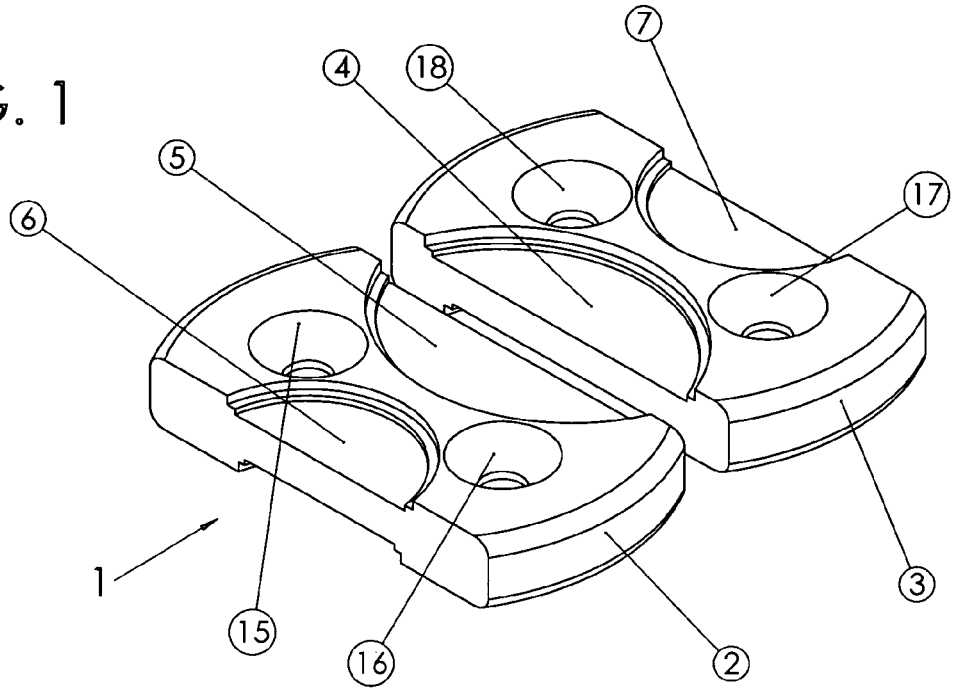
FIG. 1 is a perspective view of reversible coin holder jaws in accordance with the present invention.
Figure 2:
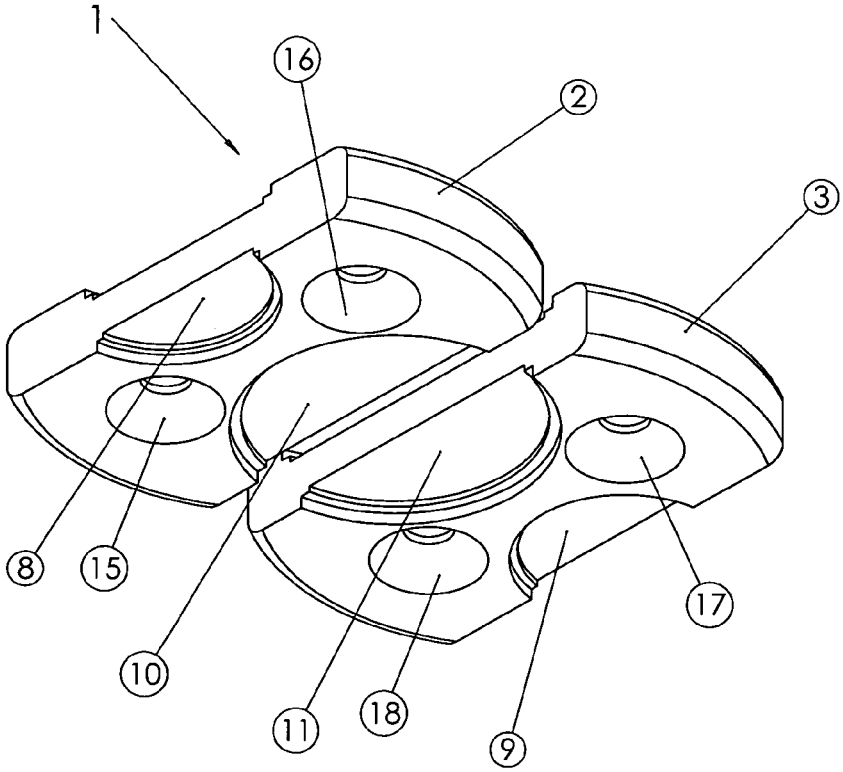
FIG. 2 is a perspective view of the same reversible coin holder jaws illustrated in FIG. 1 but viewing the opposite side in accordance with the present invention.

FIG. 1 and FIG. 2 are perspective views of reversible coin holder jaws 1 that consists of jaw 2, and jaw 3. In this first embodiment of the invention the jaws are made to fit and clamp four different sized coins. Recess 4 and recess 5 fit one size coin, recess 6 and recess 7 fit a second size coin, recess 8 and recess 9 fit a third size coin, and, recess 10 and recess 11 fit a fourth size coin. Holes 15 and 16 provide a means to fasten jaw 2 to one side of a clamping mechanism with either screws or pins. Holes 17 and 18 provide a means to fasten jaw 3 to the other side of a clamping mechanism. During use by an engraving artist or craftsman, jaws 2 and 3 are orientated so that the matching recesses for that particular coin size are facing each other and facing up.

Figure 3:
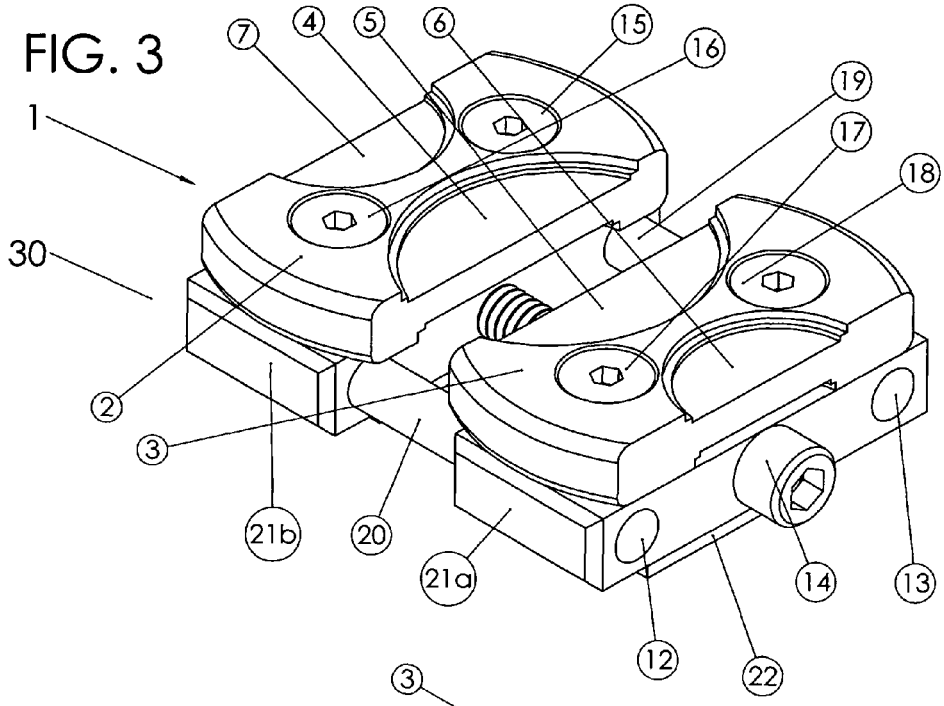
FIG. 3 is a perspective view of the reversible coin holder jaws in FIG. 1 and FIG. 2 in accordance with the present invention attached to a prior art clamping mechanism.
Figure 4:
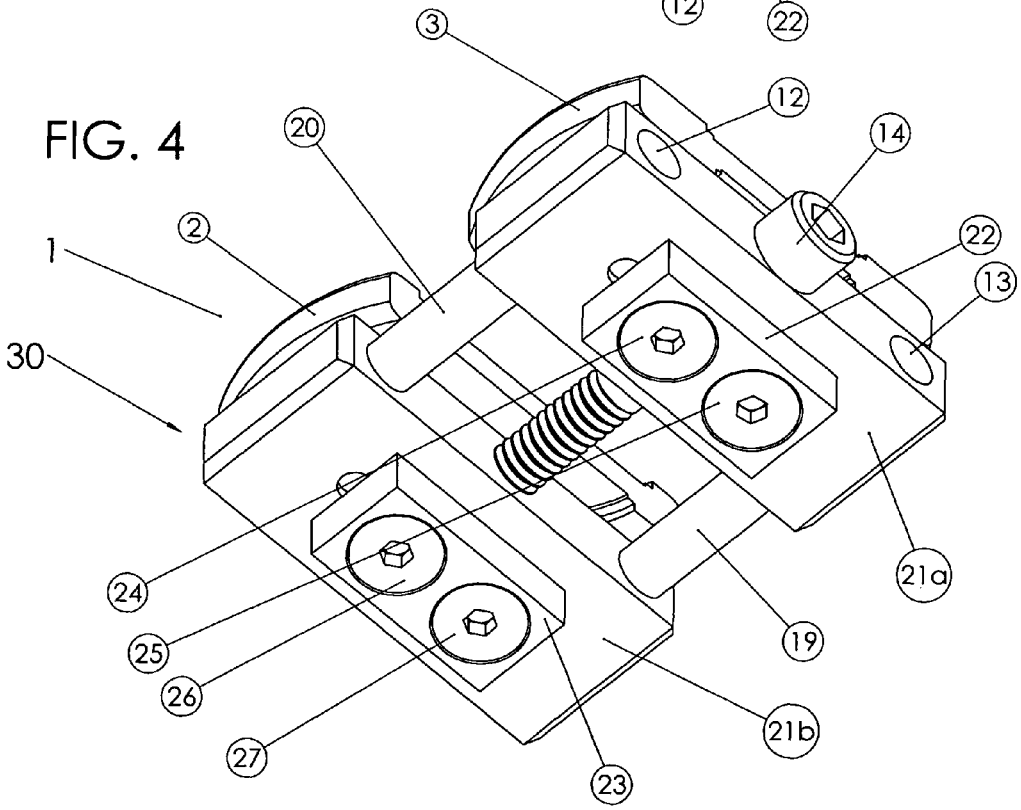
FIG. 4 is a perspective view of the bottom of FIG. 3.

FIG. 3 and FIG. 4 are perspective views of the reversible coin holder jaws 1 in FIG. 1 and FIG. 2 attached to a prior art clamping mechanism 30 in accordance with the present invention. The clamping mechanism 30 consists of block 21*a* and block 21*b* with alignment rail holes 12 and 13 running through both blocks 21*a* and 21*b*. Rails 19 and 20 can be inserted rigidly or free sliding into block 21*b*, while the two rails 19 and 20 may slide freely into block 21*a*. Screw 14 is interposed between blocks 21*a* and 21*b* for the purpose of drawing the two blocks together or apart and thus the two jaws. Raised boss blocks 22 and 23 are illustrated attached to blocks 21*a* and 21*b* with screws 24, 25, 26, and 27. Raised boss blocks 22 and 23 are included for the purpose of allowing a surface for some larger vise to clamp against as described and illustrated in FIG. 6.

Figure 5:
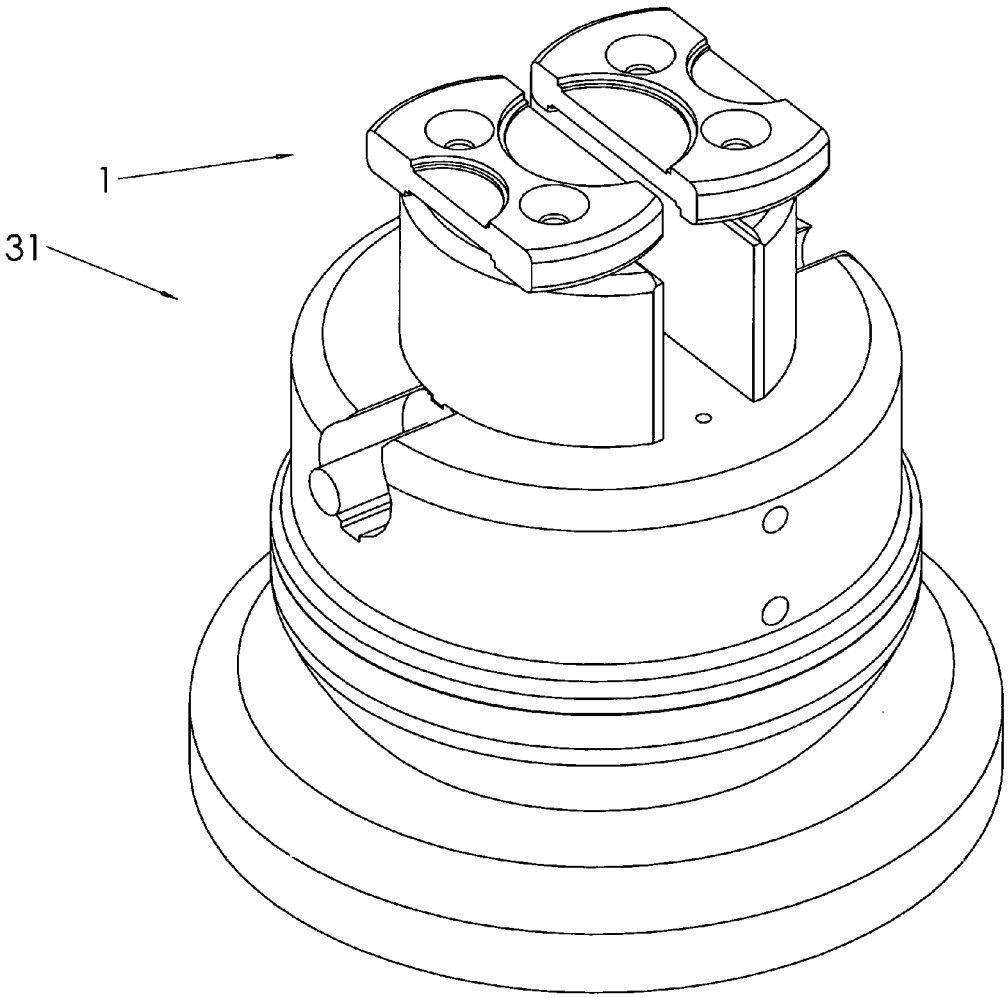
FIG. 5 is a perspective view of the reversible coin holder jaws in FIG. 1 and FIG. 2 in accordance with the present invention attached to a prior art engravers ball vise.

FIG. 5 is a perspective view the reversible coin holder jaws 1 affixed to prior art engravers ball vise 31 in accordance with the present invention.

Figure 6:
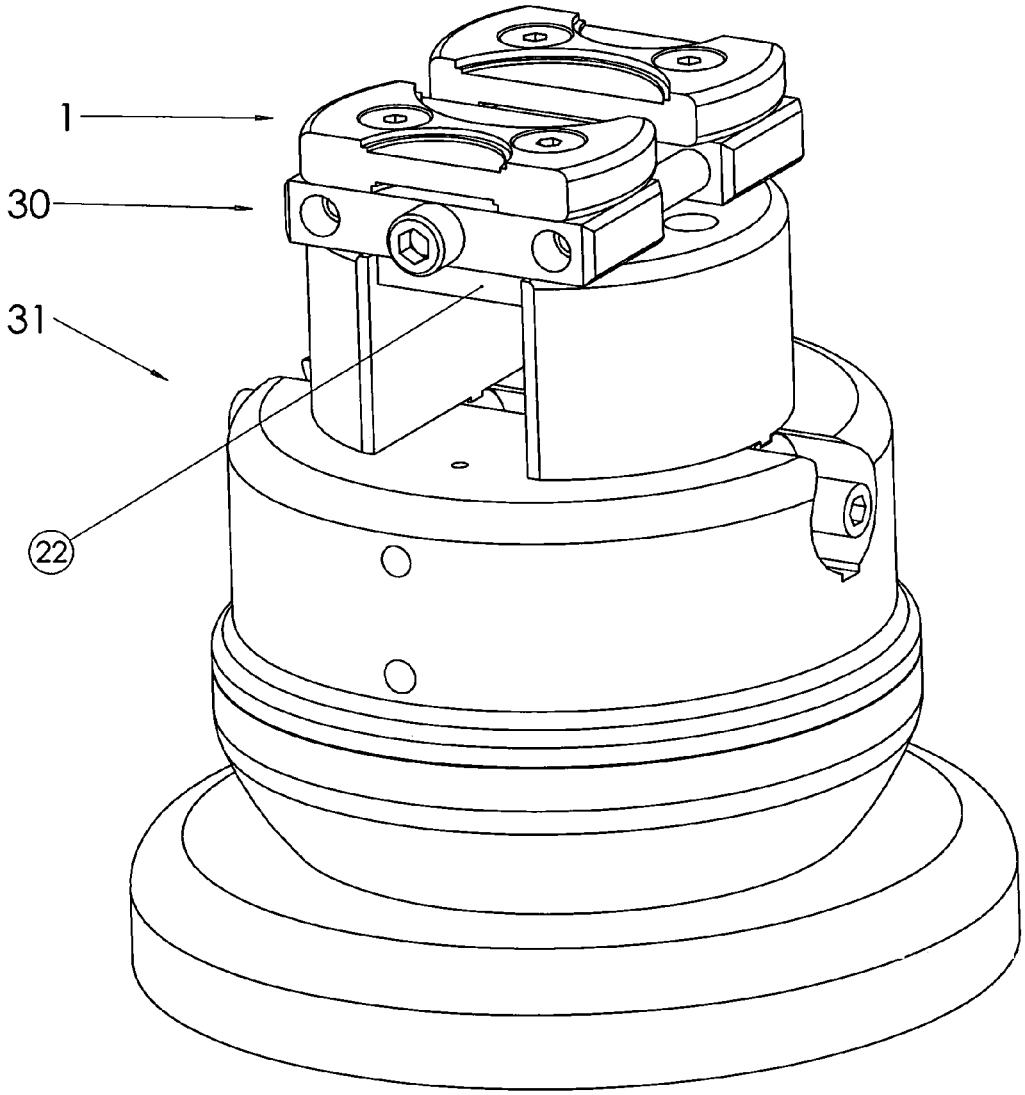
FIG. 6 is a perspective view of the reversible coin holder jaws in FIG. 1 and FIG. 2 with them attached attached to the clamping mechanism illustrated in FIG. 3 and the clamping mechanism itself placed in the jaws of an engravers ball vise.
Figure 7:
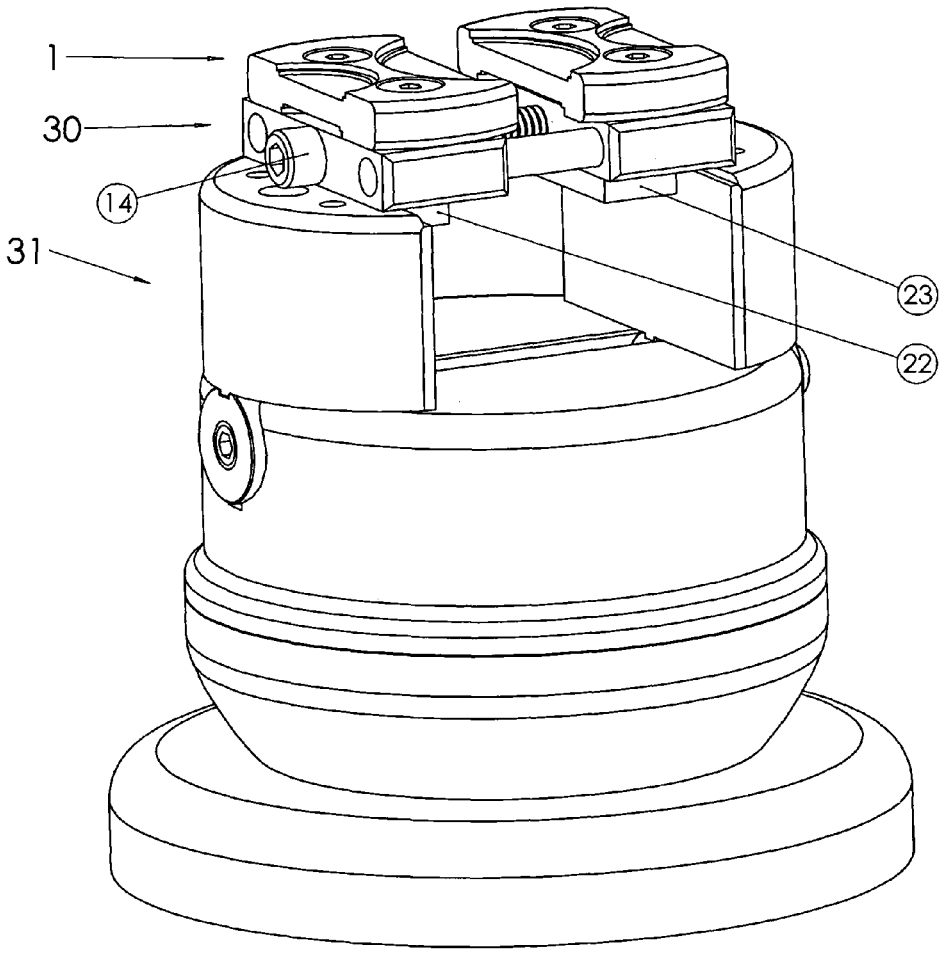
FIG. 7 is a perspective view slightly lower than FIG. 6.

FIG. 6 and FIG. 7 are perspective views of the reversible coin holder jaws in FIG. 1 and FIG. 2 with them attached to the clamping mechanism illustrated in FIG. 3 and FIG. 4 and then, in turn, this clamping mechanism is held in the jaws of a prior art engravers ball vise 31. Referring to FIG. 6, FIG. 7, and FIG. 4, the jaws of the engravers ball vise are clamped against raised boss blocks 22 and 23. In the case of FIG. 7, clamping mechanism 30, and thus reversible coin holder 1, is turned 90 degrees compared to FIG. 6. With the clamping mechanism in position as it is illustrated in FIG. 7, screw 14 could be removed if desired from clamping mechanism 30 and the use of the jaws of the engravers ball vise 31 could be used to close clamping mechanism 30.

Figure 8:
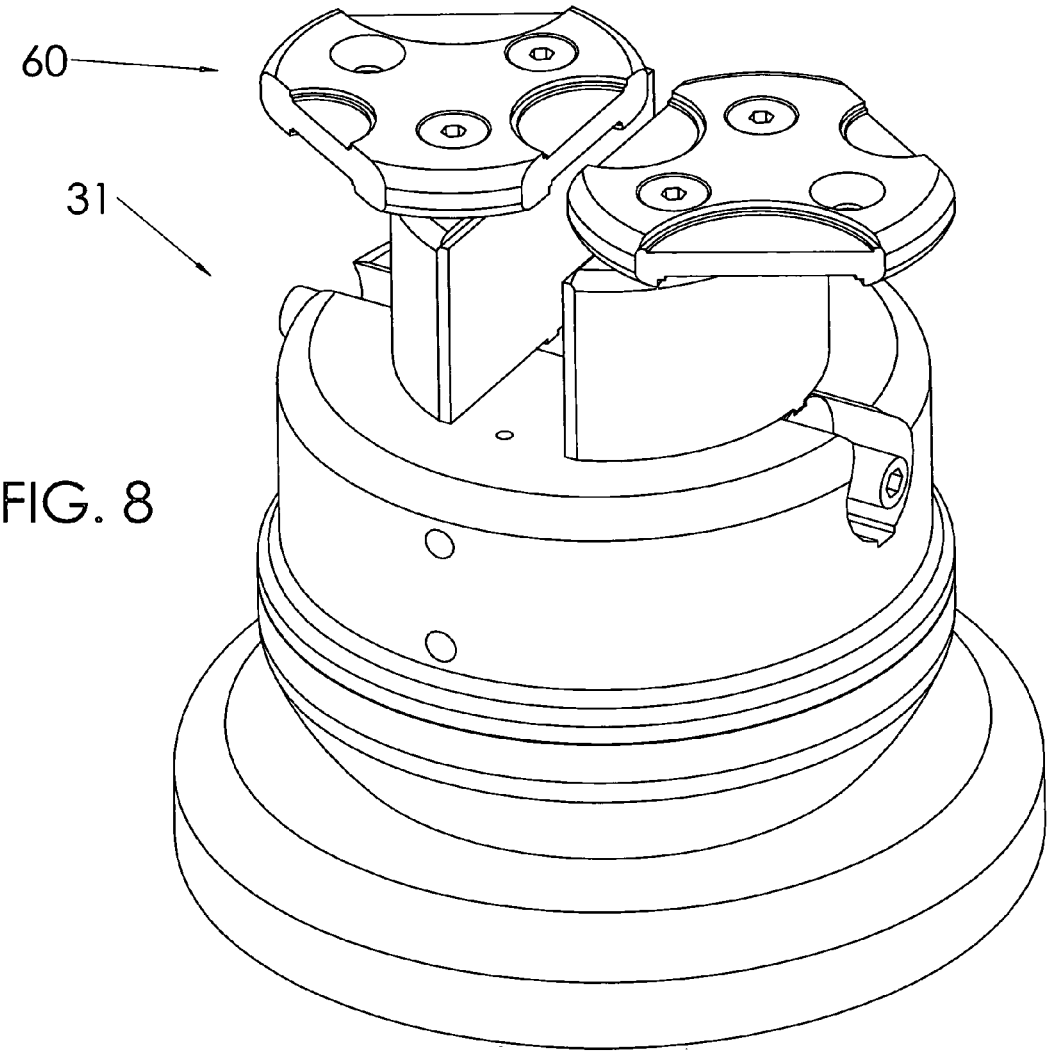
FIG. 8 is a perspective view of a second embodiment of reversible coin holder jaws illustrated attached to an engravers ball vise in accordance with the present invention.

FIG. 8 is a perspective view of a second embodiment of reversible coin holder jaws. In FIG. 8, the reversible coin holder jaws 60 are illustrated affixed to a prior art engravers ball vise 31. Reversible coin holder jaws 60 is both designed with 3 faces, allowing this second embodiment to hold six coins of differing sizes by changing the configuration of reversible coin holder jaws 60.

Figure 9:
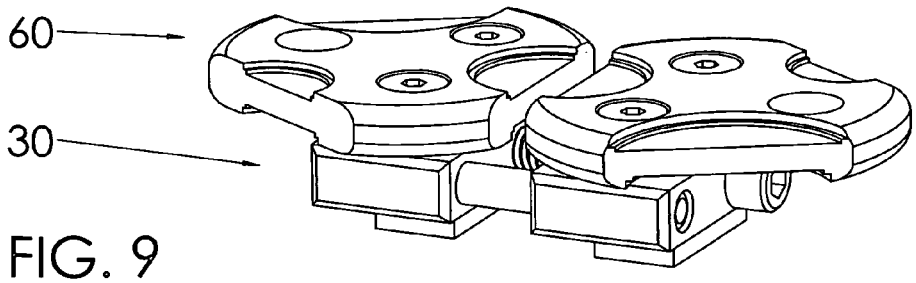
FIG. 9 is a perspective view of the same reversible coin holder jaws illustrated in FIG. 8, attached to a clamping mechanism in accordance with the present invention.

FIG. 9 illustrates reversible coin holder jaws 60 attached to the prior art clamping mechanism in manner similar to FIG. 3 and FIG. 4.

Figure 10:
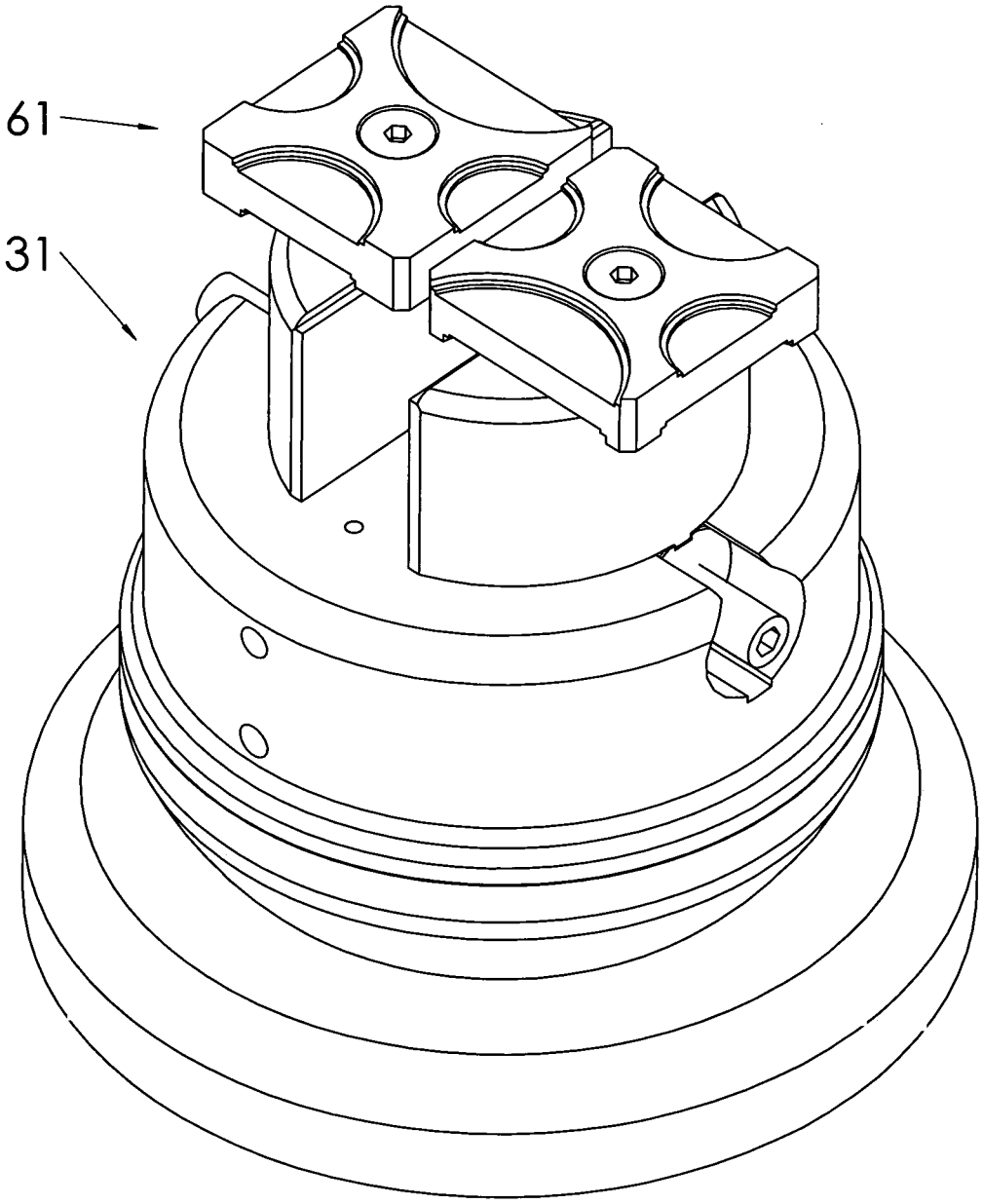
FIG. 10 is a perspective view of a third embodiment of reversible coin holder jaws illustrated attached to an engravers ball vise in accordance with the present invention.

FIG. 10 is a perspective view of a third embodiment of reversible coin holder jaws. In FIG. 10, reversible coin holder jaws 61 are illustrated affixed to prior art engravers ball vise 31. Reversible coin holder jaws 61 is both designed with four faces allowing this third embodiment to hold eight coins of differing sizes, depending on the configuration of 61. Not illustrated, but similar to the first and second embodiments, this third embodiment of the reversible coin holder jaws can be used in conjunction with the prior art clamping mechanism 30, as described previously.

FIG. 11 and FIG. 12 are perspective views of a fourth embodiment of the reversible coin holder jaws, and the preferred embodiment. Reversible coin holder 32 is built with jaws that are incorporated as part of the clamping mechanism. This fourth embodiment is made to hold 8 coins of differing sizes, depending on the configuration of the device. Block 35 and block 36 consist of a number of elements, including alignment rail holes 70 and 71, which run through both blocks 35 and 36. Cross drilled to alignment rail holes 70 and 71 are alignment rail holes 72 and 73, which, when blocks 35 and 36 are reconfigured, serve the same purpose as alignment holes 70 and 71. Rails 34 and 50 can be inserted into either set of alignment holes as required to align a particular pair of matching coin recesses. Referring to FIG. 11, matching recesses include: 44 and 48, 43, and 49, 45 and 47, 75 and 46, or referring to FIGS. 12: 51 and 58, 52 and 56, 54 and 55, 53 and 57. Through screw hole 82, screw 33 is interposed between blocks 35 and 36, for the purpose of drawing the two blocks together and clamping a coin securely. Screw 33 can be moved from screw hole 82 to screw hole 41, as required to remain parallel with rails 34 and 50. Thumbscrews 80 and 81 are used to secure rails 34 and 50. Depending on the configuration of the device, and the positions of rails 34 and 50, thumbscrews 80 and 81 might occupy screw hole 41 or screw hole 82 in the manner illustrated. Reversible coin holder 32 could be used as a stand alone holder, or placed in a larger vise. If used in a larger vise, clamp boss 83 can be attached to block 36 using screw 84 and 85 by inserting them through counter drilled holes 93 and 94 and threading them into threaded holes 90 and 91. Clamp boss 83 can then be held in the jaws of a larger vise, thereby securing reversible coin holder 32. By not attaching clamp boss 83 to block 35, the blocks 35 and 36 can be drawn together or apart without first needing to remove the device from the larger vise. Holes 93 and 94 are counter bored on both sides of clamp boss 83 to allow the block to be turned over and still align with threaded holes 90 and 91, as required to reconfigure the recesses of blocks 35 and 36.

CONCLUSION, RAMIFICATIONS, AND SCOPE

Accordingly, the reader will see that the Reversible Coin Holder provides unique features for helping coin carving artists carry out his or her work. The invention provides coin holder with jaws that are conveniently reversible for clamping multiple sizes of coins. The invention can securely clamp coins without damaging the coin that the artist or craftsman is working on.

Although the invention has been described with reference to the illustrated preferred embodiment, it should be noted that equivalents may be employed and substitutions made therein without departing from the scope of the invention as recited in the claims.

Examples of this might be:

Referring to FIG. 11 and FIG. 12, clamp boss 83 could be replaced by two smaller boss blocks in a manner similar to FIG. 4, FIG. 6, or FIG. 7.

Referring to FIG. 11 and FIG. 12, other methods could be used to secure or encapsulate rails 34 and 50 in either block 35 or block 36. One means might be a plug, be it threaded or friction fit. Another might be providing a stop, blind hole, undersized hole, or intersecting set screw mid way through rail holes 70 and 71 and/or 72 and 73.

Accordingly, the scope of the invention should be determined not by the embodiments illustrated, but by the appended claims and their legal equivalents.

We claim:

1. A method of holding various sizes of coins, comprising:

providing at least two jaws with a multiple of clamping faces to each jaw, a first side, and a second side;

a fastening method to fasten said at least two jaws to a clamping device that incorporates a biasing means to bias said at least two jaws together;

said at least two jaws having a recess on said first side and said second side adjacent to each of said multiple of front clamping faces;

each said recess being in the shape and size of a portion of the outside edge of the coin to be held in that recess;

each said recess having at least one nested step for one side of the coin to rest against while being held;

said fastening method includes a flipping-rotating design that allows said at least two jaws to be flipped over or rotated so that another set of said multiple of front clamping faces are facing each other when fastened to said clamping device;

said biasing mean includes a screw running perpendicular to two of the said multiple of front clamping faces that are currently being utilized for holding the coin;

setting a coin to be held between said at least two jaws; and biasing said at least two jaws together with said screw.

2. The method of holding various sizes of coins as recited in claim 1, said method further comprising:

a first block and a second block with at least two alignment holes in each;

at least one biasing screw between said first block and said second block for the purpose of biasing said first block and said second block together;

said at least two alignment holes running a direction parallel with each other and parallel with said biasing screw;

at least two pins inserted into said at least two alignment holes;

setting a coin to be held between said at least two jaws; and biasing said at least two jaws together.

3. A method of carving a coin, comprising:

providing two blocks having a top side and a opposite side;

said two blocks having at least four edges;

said two blocks having a thickness measured from said top side to said opposite side that is less than the distance between either two opposite edges of said at least four edges;

said top side and said bottom side each having at least four recesses made to fit various coin circumferences;

each said four recess having at least one nested step for one side of the coin to rest against;

at least two rail guides in each said at least four edges;

at least two guide rails inserted into said at least two rail guides;

said at least two guide rails running in a diction parallel with each other as well as perpendicular to the two faces that are to clamp the particular coin to be held;

at lease one screw between said two blocks for the purpose of biasing said at least two blocks together;

setting said coin to be held within one of said at least four recesses;

turning said screw; and caring out a metal working operation on said coin.

4. A device of holding various sizes of coins, said device comprising:

providing at least two jaws with a multiple of clamping faces to each jaw, a first side, and a second side;

a fastening aperture which allows a fastener to fasten said at least two jaws to a clamping device that incorporates a biasing means to bias said at least two jaws together;

said at least two jaws having a recess on said first side and said second side adjacent to each of said multiple of front clamping faces;

each said recess being in the shape and size of a portion of the outside edge of the coin to be held in that recess;

each said recess having at least one nested step for one side of the coin to rest against while being held;

said device includes a flipping-rotating bottom first and bottom second sides that allows said at least two jaws to be flipped over or rotated so that another set of said multiple of front clamping faces are facing each other when after flipping-rotating said device; and said biasing mean includes a screw running perpendicular to two of the said multiple of front clamping faces that are currently being utilized for holding the coin.

5. The device of holding various sizes of coins as recited in claim 4 said device further comprising a first block and a second block with at least two alignment holes in each;

said at least two alignment holes running a direction parallel with each other and parallel with said screw; and at least two pins inserted into said at least two alignment holes.

* * * * *